United States Patent [19]

Groetschel

[11] 4,122,682

[45] Oct. 31, 1978

[54] METHODS OF AND APPARATUS FOR APPLYING ROOF MATS TO MINE WORKINGS

[76] Inventor: Karl M. Groetschel, Jakob-Klar-Strasse 5, 8 Munchen 40, Fed. Rep. of Germany

[21] Appl. No.: 820,381

[22] Filed: Jul. 29, 1977

[30] Foreign Application Priority Data

Jul. 31, 1976 [DE] Fed. Rep. of Germany ..... 2634557
Dec. 15, 1976 [DE] Fed. Rep. of Germany ..... 2656760

[51] Int. Cl.[2] ..... E21D 19/02
[52] U.S. Cl. ..... 405/150; 405/294
[58] Field of Search ..... 61/45 D, 45 C, 45 R, 61/84, 42, 63; 299/11, 12

[56] References Cited

U.S. PATENT DOCUMENTS

| | | | |
|---|---|---|---|
| 3,107,902 | 10/1963 | Calder | 61/45 C X |
| 3,902,324 | 9/1975 | Barrett | 61/45 C |
| 4,003,208 | 1/1977 | Hornung et al. | 61/45 D |

FOREIGN PATENT DOCUMENTS

| | | | |
|---|---|---|---|
| 2,015,464 | 11/1971 | Fed. Rep. of Germany | 61/45C |
| 2,437,323 | 2/1976 | Fed. Rep. of Germany | 61/45 C |
| 2,500,951 | 7/1976 | Fed. Rep. of Germany | 61/45 D |
| 2,541,534 | 3/1977 | Fed. Rep. of Germany | 61/45 C |

*Primary Examiner*—Dennis L. Taylor
*Attorney, Agent, or Firm*—Spencer & Kaye

[57] ABSTRACT

A method of applying a protective wire mesh mat to the undersurface of the roof of an underground mine working and apparatus for applying such mat wherein a coil of the mat is carried on a supporting spindle and is paid out against the undersurface of the roof through a vertically convergent passageway defined by upper and lower jaw plates of an applicator. The applicator has an open side through which the margin of the last applied strip passes so as to be in overlapped or edge to edge relation with the mat strip undergoing application. A coil of fastening strip incorporating staple-like fastening elements is also carried by the apparatus and paid out through the applicator passageway in overlapped relation with the two mat strips and is caused by the convergence of the jaw members firstly to penetrate the two mat strips and then undergo downward bending of the prongs of the staple-like fastening elements before passing out of the exit of the convergent passageway.

26 Claims, 35 Drawing Figures

Fig. 10A
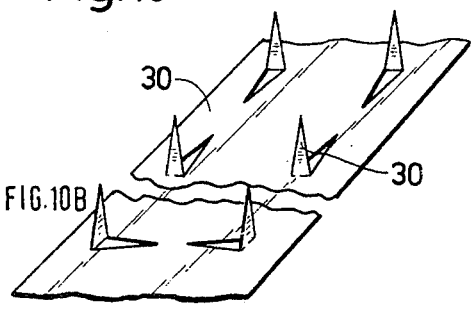
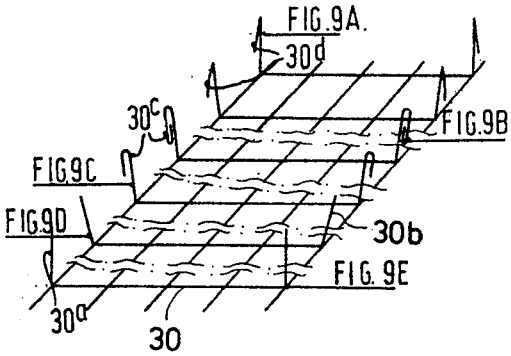
Fig. 12
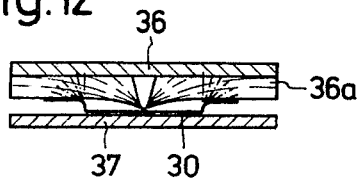
Fig. 14
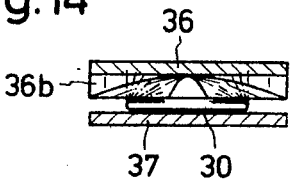
Fig. 11
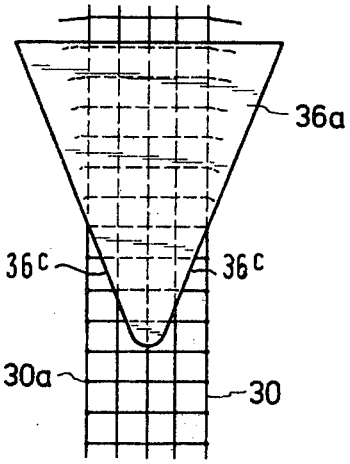
Fig. 13
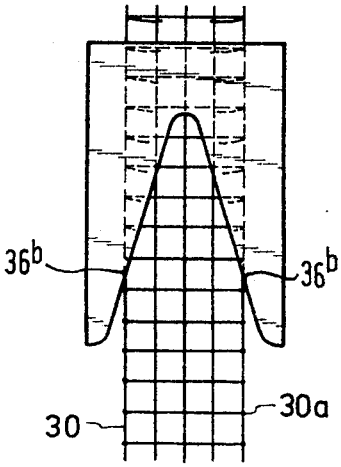
Fig. 8
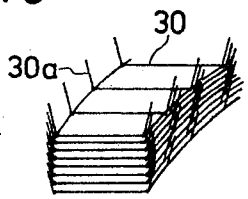
Fig. 7
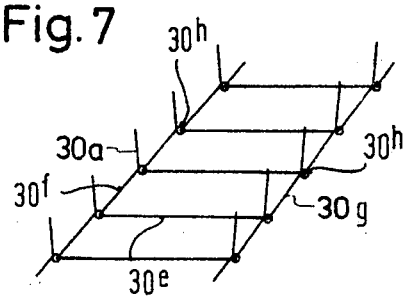

Fig. 15
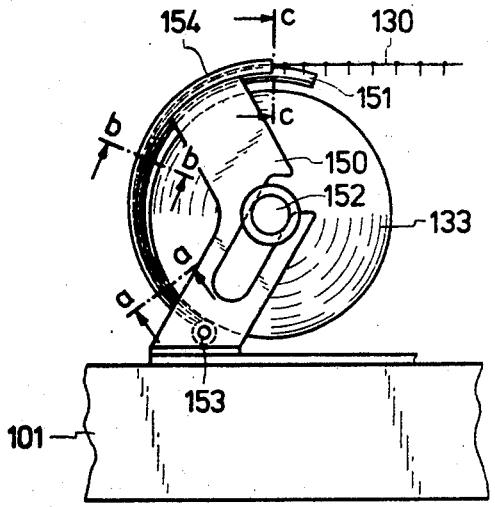
Fig. 16
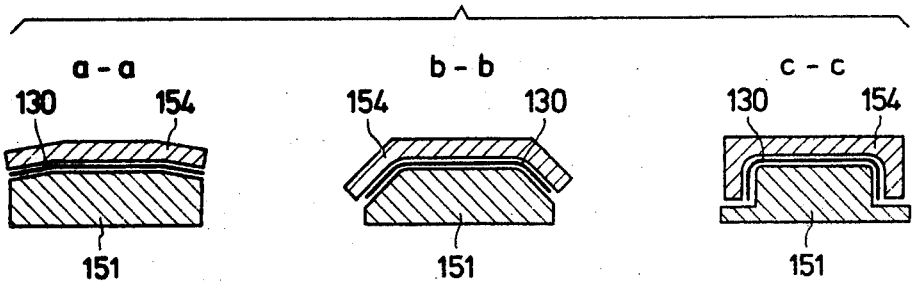
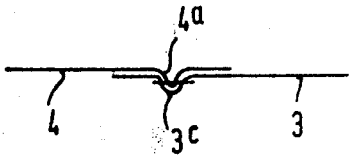
FIG. 17A
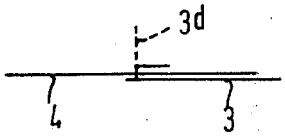
FIG 17B

METHODS OF AND APPARATUS FOR APPLYING ROOF MATS TO MINE WORKINGS

BACKGROUND OF THE INVENTION

This invention relates to a method of supporting the roof of an underground mine working comprising stationing beneath said roof a flexible mat having a stored portion and an extended portion leading off from said stored portion, supporting said extended portion at an elevated position adjacent to said roof, holding said elevated portion stationary at a succession of such elevated positions while moving said stored portion along a succession of generally parallel laterally offset paths to withdraw further lengths of mat from said stored portion, and underpinning said extended portions at intervals along their lengths by prop-supported superstructure. The invention also relates to an apparatus for use in carrying out the method.

Such a method and apparatus is the subject of U.S. Pat. No. 3,399,927 already issued to me and of my application for U.S. patent Ser. No. 693,114 filed on June 4, 1976.

Methods involved in the use of the forms of apparatus disclosed and claimed in the aforesaid patent and application, although providing an improvement in the safety of personnel working beneath the roof, does not make provision for connection between the generally parallel portions of mat so that there is a risk that gaps will be left or will develop between adjacent portions of roof mat and the safeguard offered by the mat to descent of roof material would, therefore, not be established in respect of such gaps.

To secure adjacent portions of roof mat together by manual methods involves considerable work, is expensive, and gives rise to accident risks to an extent which is undesirable in mechanised mine workings.

The principal object of the present invention is to overcome or reduce these disadvantages.

SUMMARY OF THE INVENTION

In accordance with one aspect of the invention I provide an improvement of the method hereinbefore referred to comprising the steps of bringing into proximate relation an edge of the extended portion of mat undergoing application to the roof along each of said paths with an edge of the extended portion of the mat applied to the roof along the immediately preceding one of said paths, and mechanically fastening said extended portions together adjacent to said proximate edges as the mat undergoing application is applied.

From a further aspect the invention resides in the provision, for use in performing the method, of an apparatus for applying a flexible mat to the roof of a mine working along a plurality of generally parallel laterally offset paths comprising mobile means including a body, means thereon for storing a portion of flexible mat while permitting an extended portion to be led off from said stored portion for application to the underface of the roof, applicator means for bringing into proximate relation an edge of the extended portion of mat applied to the roof along each of said paths and an edge of the extended portion of mat applied along the immediately preceding path, means for mechanically fastening said extended portions of mat together adjacent to said edges.

From yet another aspect the invention resides in the provision, for use in performing the method, of fastening means for mechanically fastening adjacent portions of mat material for application to the undersurface of the roof of a mine working, said fastening means comprising a plurality of projecting elements for penetrating the mat material, and means connecting and spacing said projecting elements in longitudinal succession.

From yet another aspect the invention resides in the provision of a roof mat structure for use in application against the undersurface of a mine roof comprising a plurality a strip-like portions of mat material arranged in successive laterally offset but with adjacent edges proximate to each other, and means on or associated operatively with said mat portions establishing a mechanical connection between them.

BRIEF DESCRIPTION OF THE DRAWINGS

The invention will now be described, by way of example, with reference to the accompanying drawings wherein:

FIG. 7 illustrates one embodiment of a fastening strip for use in the method of the invention;

FIG. 8 shows fastening elements for use in the method of the invention and of channel form;

FIGS. 9A to 9E illustrate various forms of fastening elements each of which may be incorporated in a fastening strip;

FIGS. 10A and 10B illustrate further embodiments of fastening strip for use in the method of the invention;

FIG. 11 is a diagrammatic top view of one embodiment of a deforming element associated with the stapler device forming part of either embodiment of apparatus in accordance with the invention;

FIG. 12 is a sectional illustration;

FIG. 13 is a plan view of the element of FIG. 12;

FIG. 14 is a sectional view of a deforming element modified as compared with the element shown in FIGS. 11 and 12;

FIG. 15 is a view in side elevation illustrating a deforming device for the fastening elements and which is associated with the support means for the stored supply of fastening elements;

FIG. 16 are diagrammatic representations of sections through different points of the deforming device shown in FIG. 15;

FIGS. 17A and 17B show alternative ways of mutually fastening two mutually overlapping regions of roof mat portions laid along adjacent paths;

DESCRIPTION OF THE PREFERRED EMBODIMENTS

Figure 1:
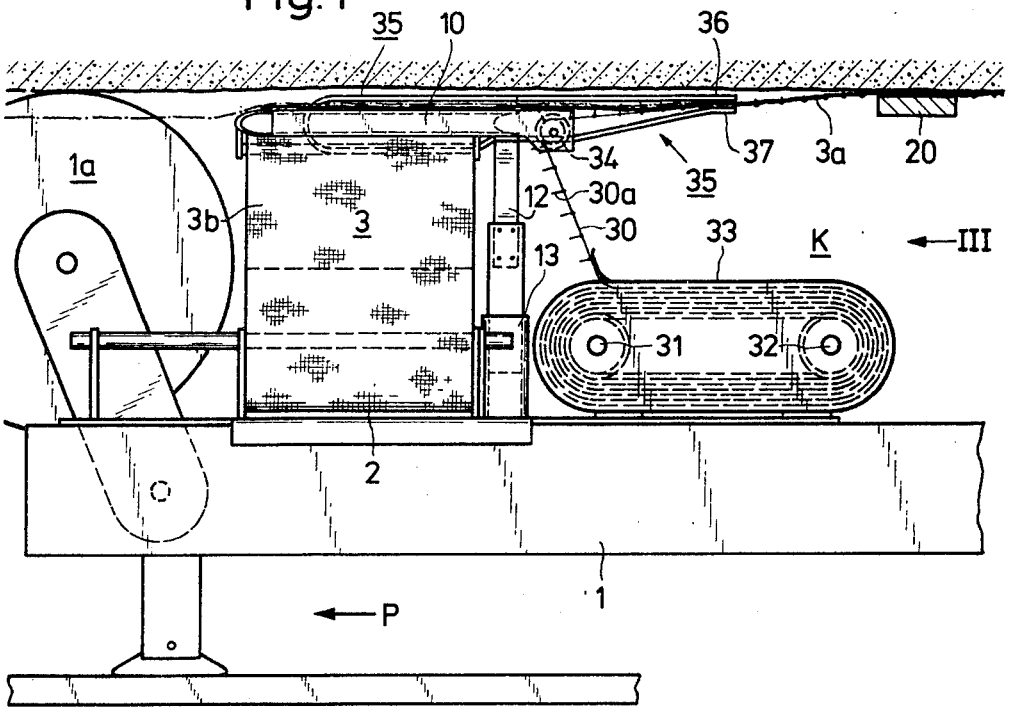
FIG. 1 is a view in side elevation of one embodiment of apparatus in accordance with the invention for use in performing the method thereof in laying a safety net parallel with a coal face.
Figure 2:
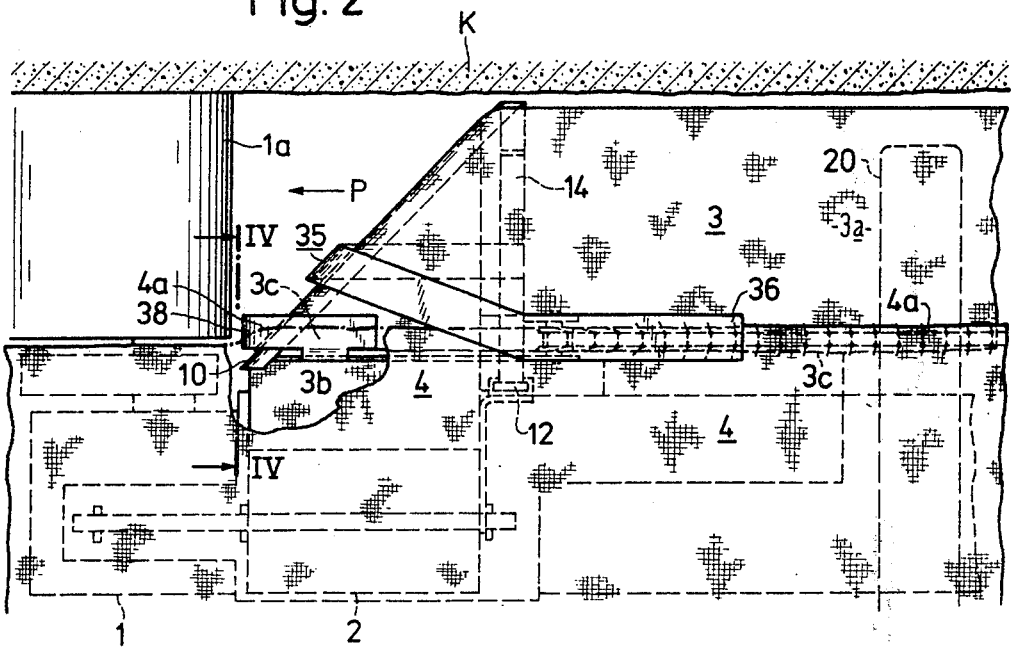
FIG. 2 is a plan view.
Figure 3:
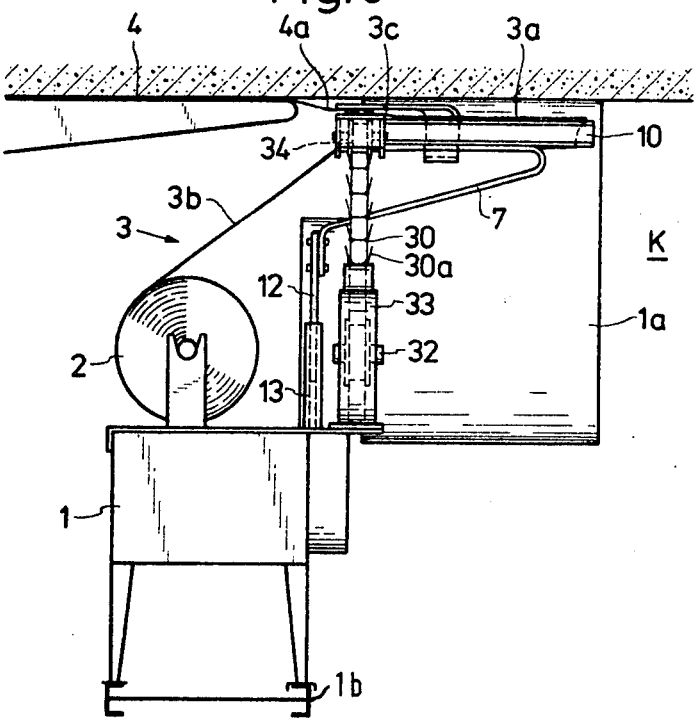
FIG. 3 is a view in the direction of the arrow III in FIG. 1.

As shown in FIGS. 1 to 3, a drum or cylinder 2 is mounted on a coal cutting machine of which the base 1 is guided along a track 1*b* which extends parallel to a coal face K. A strip 3 of wire mesh roof matting material has a stored portion coiled on said drum 2. After the leading end of the matting 3 has been securely clamped to the roof, the matting is automatically paid out to form an extended portion as the coal cutting machine advances in the direction of the arrow P. As seen in FIG. 2 the matting is paid out from the drum in a direction oblique relatively to the coal face K. The necessary diversion into a direction parallel with the coal face is achieved by conducting the matting strip over a suitably angled deflector or guide 10. This deflector 10 is a component part of a mat-applicator or mat-laying device which is supported elastically by a leaf spring (FIG. 3) which in turn is supported in vertically adjustable manner on a telescopic prop 12, 13 which is likewise mounted on the coal cutting machine 1. The vertical position adjustment of element 12 of this prop can be adjusted in conformity and automatically with the vertical position of the cylinder 1*a* of the coal cutting machine. As illustrated, a portion 3*a* of the extended, i.e. uncoiled, length of roof matting 3 is shown as already having advanced past the deflector 10 and is firmly applied to the roof at a suitable distance from said deflector by the forepoled portion of the roof supporting superstructure 20 of a roof support unit, such as that disclosed in my prior U.S. Pat. No. 3,399,927. When this portion of the roof mat has been finally underpinned in this manner, another portion 3*b* of the matting still occupies the span between the drum 2 and the deflector 10.

As will be observed from FIG. 2, the marginal region 3*c* on the side which is remote from the coal face of the roof mat portion 3*a* which has been applied to the roof overlaps the marginal region 4*a* nearest the coal face of the previously laid roof mat strip 4 which is already part and parcel of the overall safety mat cover for the whole of the supported length of the working. The extended portions 3 and 4 are applied to the underside of the roof in successive parallel, but laterally offset, paths of travel of the coal cutting machine carrying with it the coiled stored portion of the mat.

Figure 4:
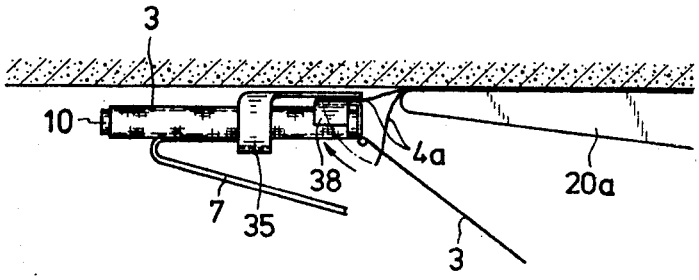
FIG. 4 is a view according to the section line IV—IV in FIG. 2 showing part of the embodiment.

This marginal region 4*a* has been lifted and straightened from a potentially sagging or downwardly bowed position, which it may have assumed before the position shown in FIG. 4, into a suitable position for connection to the marginal region 3*c* of the new roof mat portion 3 by means of a straightening or guide plate 38 (FIGS. 2 and 4) with an angled forward end portion arranged on the mat-applicator device in such a way as to extend beneath the outer edge of the marginal mat zone 4*a* when the applicator device is advanced, to lift this edge to the required level.

Now, during the mat-laying process itself, a fastening band or strip 30 (FIG. 7) is applied to the mat portions to fasten these together. In one form the fastening strip comprises a chain. Each link of the chain may be formed of a length of wire bent to provide a cross portion 30*e*, two integral side portions 30*g* extending lengthwise of the strip parallel to each other and connected to projecting elements 30*a* by integral loops 30*h*. The strip may be of suitable width and structure incorporating projecting elements of any of a number of forms such as pins, teeth, hooks, spikes or like elements 30*a* to 30*d* and 30*i* (FIGS. 9 and 10). The fastening strip is fed towards the junction zone of overlap between the two roof mat portions 3 and 4 which are to be fastened together. This fastening strip 30 may be a wire link chain (FIG. 7) incorporating projecting elements 30*a* in the form of wire pins extending transversely to the plane of the strip and are situated at the joints between link elements of the chain. These pins are preferably inclined by an angle of a few degrees relative to the plane of the chain link in a direction laterally outwardly (FIGS. 7 and 8). This imparts to the strip approximately the form of a divergent trough or channel formed of links (FIG. 8). Such channels can be economically stacked to occupy comparatively very little space and can also be coiled up in this form. A comparatively large supply which may be sufficient for the whole length of a working may be stored in coiled form in the manner shown in FIGS. 1 and 3 on a twin reel with parallel axes 31, 32 which are spaced apart to a greater or lesser extent depending on circumstances. In the illustrated example a cassette 33 which is removably mounted on the coal cutting machine 1 serves as a replaceable magazine for this coiled supply of fastener strip.

This cassette 33 is aligned with the guide pulley 34 which is secured to the rear side of the mat-applicator device below the roof mat portion 3*a* which is shown as undergoing application to the roof. The guide pulley 34 conducts or feeds the fastening strip paid out during forward travel of the coal-getting machine by the magazine 33 to the junction zone of the roof mats. Preferably the feed path along which the strip is advanced by the pulley 34 extends (as viewed in side elevation) at an acute angle of a few degrees relative to the roof mat portions to be fastened, so as to permit of a gradual meshing or interengagement of the projecting elements 30*a* through openings of the roof mat portions 3 and 4 and avoid malfunction right up to virtually complete penetration of the mat portions by the fastening elements. The optimum feed angle depends on the length of the projecting elements 30*a* which in turn depends on the mesh size of the roof matting.

A very low feed angle is of greater importance in association with foil-covered matting material because it is advantageous with regard to piercing of the foil material that the points of the fastening elements should impinge as nearly as possible at right angles to the plane of the matting material. The piercing of any such foil material may be facilitated by perforating the marginal regions of such roof matting material by means of spiked rollers prior to feeding them to the applicator device. On the other hand, if non-mesh, non-textured, fastening strip itself is formed on imperforate material as seen in FIGS. 10A, 10B, the foil covering along the marginal regions of the roof matting strips may be dispensed with since the fastening strip in these regions will overlap the marginal regions.

The fastening strip cassette 33 and the associated guide pulley 34 are preferably mounted for a limited amount of movement in the direction of their axes. By such adjustment of the position of these two mutually aligned parts it is possible to compensate variations in the relative positions of the marginal roof mat regions to be fastened together.

The next step of the method involves the mechanised deforming, e.g. turning or bending over of the fastening elements which extend through the roof mat portions 3 and 4 in the junction zone so that these fastening elements will firmly interlock the two roof mat portions together. Depending on circumstances (form of the roof matting material, design of fastening elements, and condition of the roof) this may be done in a particularly simple manner in the regions which are directly engaged by the roof bars of the forepoled support units by the applied roof bar pressure. Thus, a fastening strip may incorporate a comparatively large number of fastening elements (e.g. 200 and more per metre of length) and this ensures that a minimum number of effective, i.e. interlocked, individual fastenings will be established sufficient for the mat and working as a whole.

In the embodiment shown in FIGS. 1 to 4 a device 35 for deforming, i.e. turning over and pressing down the fastening elements into the operative, i.e. interlocked, fastening configuration position is provided, which device is preferably secured to the mat-applicator device 10, 12. It comprises a pair of jaws 36, 37 defining a tapering passageway in the direction along which the fastening strip passes through it, i.e. opposite to the direction of movement of the roof mat-applicator device as a whole. One of said jaws, 36, is effective above the junction zone of the roof mat portions and the other, 37, beneath said zone. The lower jaw 37 is mounted on a rearwardly situated bar 14 (FIG. 2) of the mat-applicator device. The upper jaw 36 consists of a looped strip of steel secured to the same bar 14 and looped around the deflector 10 in such spaced relation therewith as to permit unobstructed passage of the roof mat 3. The portion of the mat undergoing application to the roof passes over the deflector or guide 10 and beneath the underface of the upper jaw 36 and beneath the adjacent margin of the marginal region **4*a* of the already applied mat will lie beneath the underface of jaw 36**. The fastening strip enters the space between the upper and lower jaws at the left-hand end of the lower jaw in a region about midway between the ends of the upper jaw. All three layers, namely the overlapping portions of the mats and the fastener strip therebeneath pass out of the shallow exit at the right-hand ends of the jaws.

This device 35 sweeps, during travel of the coal cutting machine, over both sides of the marginal junction zones **3*c*, 4*a* of the roof mat portions 3, 4 which are overlapped on their underside by the fastening strip 30 and progressively penetrated by the fastening elements on said strip, so that the fastening elements are successively received between the jaws 36, 37 and the projecting elements of the fastening strip which penetrate through the mats are turned down into operative fastening, i.e. interlocked, position. This device chiefly turns the fasteners down, or over, in the direction of travel of the machine and in this position a satisfactory fastening can be quite readily produced, provided all four of the elements concerned in the fastening operation (3*c*, 4*a*, 30**) are sufficiently firmly compressed and the roof matting as well as the fastening strip have a suitably formed structure and material composition.

However, having regard to a given roof matting material, should it be desirable that the fastening elements be more severely splayed outwardly, this can be achieved, for example by a deforming means comprising wedge **36*a* (FIGS. 11, 12) which is preferably arranged on the underside of the top jaw 36. Such wedge 36*a* would have its side elements 36*c* engaged by the inner side of projecting elements 30*a* to splay these outwardly until they pass beneath the wedge. The fasteners will, however, normally be turned in the opposite direction, i.e. laterally inwardly. This can be ensured by providing on the upper jaw 36 a deforming device as seen in FIG. 13. This comprises a plate having a slot bounded by edges 36*b* tapering towards each other in the direction of feed of the fastening strip and deflecting projecting elements 30*a* laterally inwardly until they pass beneath the flattener over the fasteners (FIGS. 13, 14**). Both mat portions and the fastening strip would pass beneath this plate, which may be close to the lower jaw and serve also to press the mat portions downward closely against each other and the fastening strip.

Instead of wedge-shaped deforming means it is possible to fit grooved or fluted shallow rollers to the upper jaw of the device. During operations such rollers would be pulled along the rows of fastening elements to deflect them as required.

Figure 5:
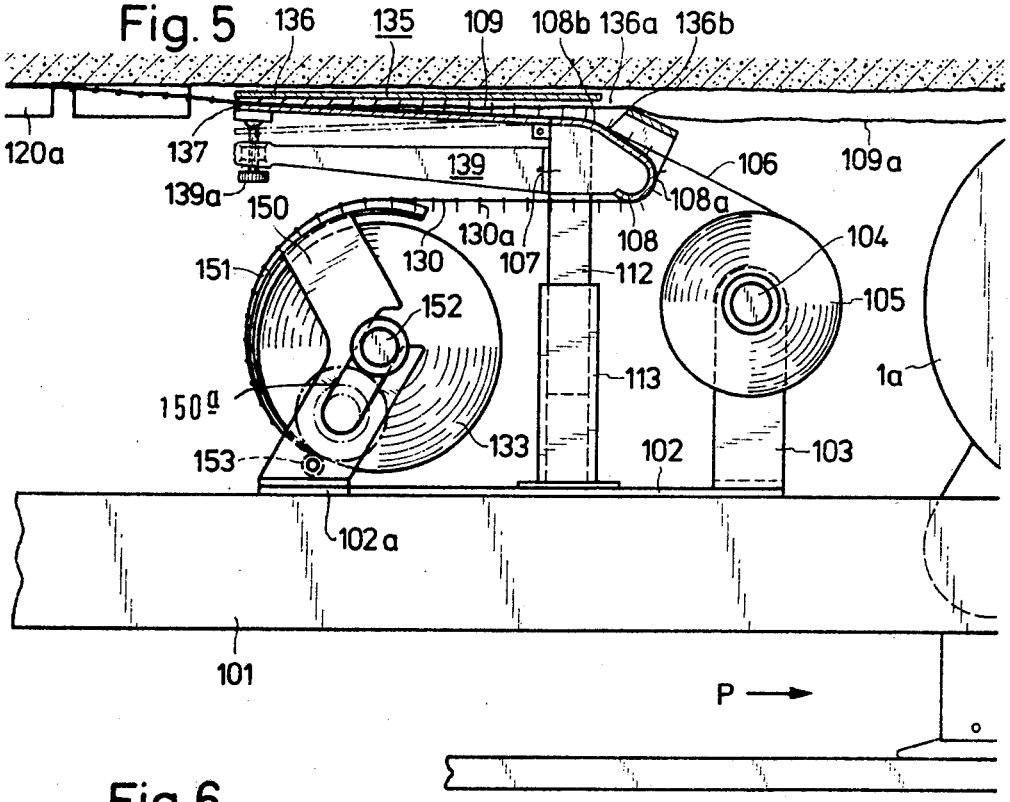
FIG. 5 is an inside elevation view of a modified embodiment of the invention.
Figure 6:
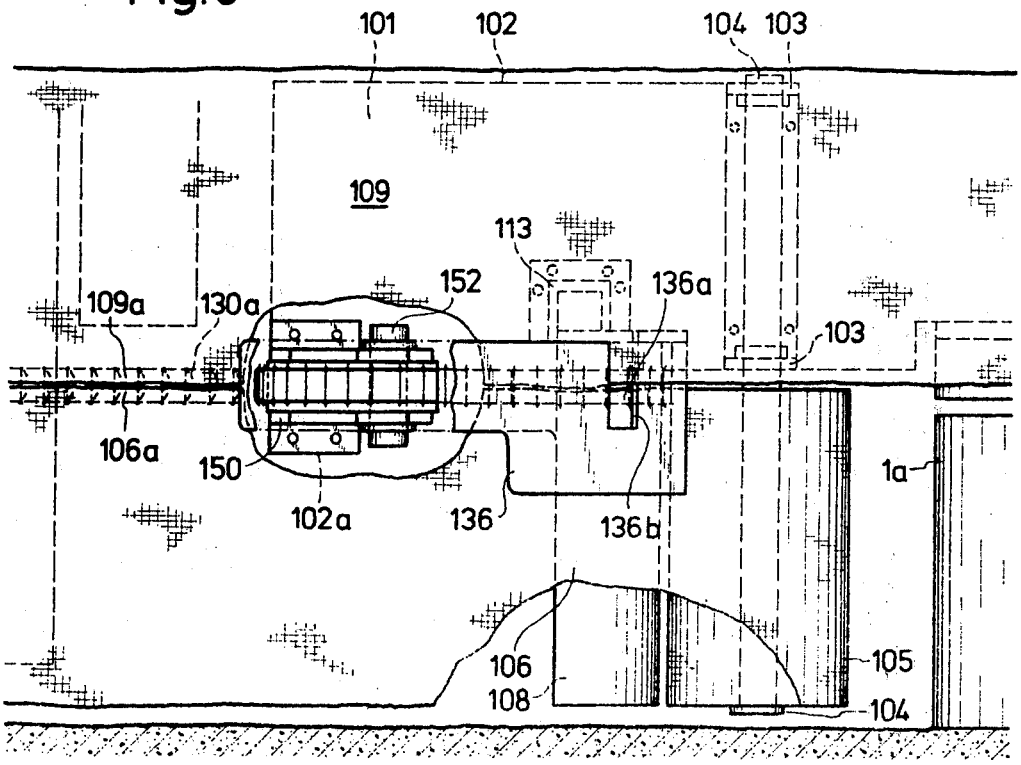
FIG. 6 is a plan view.

The modified embodiment of the invention depicted in FIGS. 5 and 6 comprises a base plate 102 mounted on a coal-cutting machine 101 guided along a track **101*b* extending parallel to the coal face. The machine 101 is fitted with upright supports 103 for supporting arm 104 of a coiled supply 105 of roof matting 106. The arm 104 forms a cantilever extending towards the newly exposed area of the working and supports coil 105 in this region adjacent to the coal face. A portion of the matting 106*a* paid out from the coil is firmly clamped to the roof by a part 120*a* of the roof support system, having previuosly passed through the jaws 136, 137 (FIG. 5) of a fastening device 135, which jaws converge under an acute angle. This fastening device is itself supported by a telescopic prop 112, 113 likewise mounted on the base plate 102. As will be observed from the left-hand side of FIG. 6, the marginal regions 106*a*, 109*a* of roof mat strips have been fed to this fastening device in laterally overlapped positions, and the fastening elements 130*a* have been bent or turned over towards the centre of the fastening strip 130** which overlaps and joins both of the relatively adjacent mat portions.

The lower jaw 137 is secured to a deflector 108 extending parallel with the coiled matting supply 105 and secured at one side by means of a plate 107 to the prop 112. This jaw may be supported as a freely cantilevered elastic element from deflector 108 to bear against areas of roof mat and fastening strips travelling through the gap between the two jaws and will operate satisfactorily. On the other hand, a more adaptable mounting of the fastener device 135, having regard to its purpose, is achieved by mounting the jaw 137 for pivotal movement about a horizontal axis on the deflector 108, as in the preferred embodiment of the invention represented in FIG. 5, and providing suitable auxiliary support means, e.g. a thrust spindle 139*a* for adjustably supporting its effective or operative end. Such spindle 139*a* may be supported on a bracket 139, as illustrated, which is rigid with the deflector 108. A further advantage arises from the fact that it is substantially easier for the various regions of roof mat and fastening strips which are to be secured together to enter into the operative range of the fastener jaws when the lower jaw 137 is capable of pivotal movement in a downwardly direction.

The top edge of the deflector 108 guides the new roof mat portion 106 into the fastener device 138. The deflector also guides the fastening strip 130 which is progressively paid out from a coiled supply 133 into the fastener device 135. The supply coil is mounted in a forked holder 150 carried on an extension lug 102*a* of the base plate 102. A part-circular portion 108*a* of the deflector 108 guides the fastening strip 106 which is withdrawn from the coiled supply 133 over a crescent or sickle-shaped guide part 151, into the correct direction for entering the fastener device 135. The crescent or sickle-shaped part 151 assists in detaching the strip 130 from the remaining coiled portion. Such strip is fitted with projecting elements 130*a* splayed outwards by an angle of a few degrees and directed radially inwardly towards the coil axis in the region of the coil.

On being conducted over the deflector 108*a*, the pin-like fastening elements successively adopt their correct upwardly directed positions and the row of fastening elements which is nearest to the coal face begins to engage in the new extended roof mat portion 106 along the ascent towards the upper operative face 108*b* of the deflector 108 so that when it has eventually arrived at this face 108*b* the fasteners penetrate fully through this roof mat portion 106. The other row of fasteners, which is remote from the coal face, will engage with the marginal region of the previously laid roof mat strip 109 only beyond, i.e. to the left of, the upper deflector face 108*b*. The upper jaw 136 includes a slit 136*a*, open on the rear side, i.e. the side remote from the coal face and nearest to the support system to admit the margin of the roof mat strip 109 into the operative range of the fastener device 135. It will be appreciated that all other parts of the device 135 and of the deflector 108 mounted on the prop 112, 113 are of such form and disposition that they cannot obstruct the smooth feed of extended portion of roof mat and fastening strip. In this arrangement the edge 136*b* of the slit 136*a* performs the function of the straightening part 38 in FIGS. 2 and 4, that is of raising and straightening out the margin 109*a* of roof mat portion 109 which may have sagged or bowed prior to entering the slit. The actual fastening operation will then be executed substantially as in the arrangement according to FIGS. 1 to 4, with such adaptations as will readily be apparent.

The forked holder 150 for the coiled supply 133 of fastening strip 106 includes a slot 150*a* which is inclined downwards towards the narrower lower end or point of the guide part 151 which represents the detachment point for the fastening strip 106, as will be seen in FIG. 5. A supporting means is mounted at the bottom of the slot 150*a* for rotation about an axis parallel to spindle 152 carrying the coiled fastening strip. This supporting means may comprise a roller 153 or a suitable plate and provides a constant support for the supply coil 133 which is guided slidably in slot 150*a* of the holder 150 by its spindle 152, as the coil diameter decreases progressively with pay out of the strip. Consequently the fastening strip 130 uncoiled from the supply can always be fed to the narrower end or point of guide part 151 in a substantially tangential direction.

In the embodiment of the invention according to FIGS. 5 and 6 it may be of particular advantage to use a fastener band of one of the forms illustrated in FIGS. 9A to 9D, each of which comprises a grid or screen-like arrangement of intersecting wires which are preferably bonded together by galvanizing or similar methods. It is envisaged that a strip of any of these forms will be initially flat, the transversely projecting portions of the cross wires being bent upwards to form the upright fastener pins in a comparatively relatively simple manner, for example by drawing the initially flat bond or strip through a bending device. Such device may comprise a suitably formed die and a roll of appropriate diameter which presses the middle region of the hand, which is to remain flat, into the die with a gradual transitional region to produce the desired form.

One embodiment of such a bending device is shown in FIG. 15. In this embodiment the guide part 151 forming a male die co-acts with a female die or shoe 154 extending around the guide part 151 at a small radial spacing from its outer face and secured to the holder means 150. The cross-section of the fastening strip which is drawn tangentially through the space between male and female die elements will be progressively deformed as shown in FIG. 16. In the region (*a*—*a*) behind the point of entry the edges of the fastening strip which are provided with the fastening elements are still nearly co-planar with the remaining central part of the strip. By the time the strip emerges from the space between the dies of the device it will have taken up its final shape, for example (*c*—*c*) wherein the fastening elements are erect and ready for operative engagement with the roof mat portions.

The method of providing a safety net of wire mesh or other suitable material to cover the whole of a given roof support system in a mine working is described with reference to FIGS. 1 to 4 may be summarised as follows.

The coal cutting machine 1 carries the supply 2 of roof matting material 3 to be newly laid as well as the magazine or store 33 containing a supply of fastening strip 30 which is to be laid in timed coordination with the roof mat. The roof matting 3 is guided into the correct direction for application to the roof by means of the deflector 10 and positioned in juxtaposed relation with the previously laid strip 4 of roof matting, preferably in such a way that the marginal zones 3*c* and 4*a* of the two strips of roof matting will be suitably overlapped. The potentially sagging margin 4*a* of the previously laid strip 4 may be raised up into a suitable position for securing to the new roof mat strip 3 by a sheet metal guide 38 or like member fitted on the mat-applicator device. The fastening strip 30 is fed to the fastener device 35 by means of a guide pulley 34 in such a manner as to be aligned or overlapped with the two roof mat margins 3*c* and 4*a* in the direction of travel. Continuously progressive and smooth engagement of the projecting elements 30*a* with the roof mat margins to be fastened together is ensured by feeding the roof mat portions and the fastening strip 30 at relatively different angles to the fastener zone between the two jaws 36, 37 of the fastener device. As the fastening strip 30 and the margins 3*a* and 4*a* of the roof mat portions are pulled through the gap between the two jaws 35, 36, the fastening elements are deformed for interlocking engagement with the roof mat margins. The energy required for such deformation is derived from the drining power during forward advancement of the coal cutting machine 1. The roof support elements which clamp the extended roof mat portions together with the connecting fastening strip 30 to the roof will cause further portions of roof mat and fastening strip to be drawn out of the gap between the two jaws 36, 37 during movement of the coal cutting machine along the coal face. This tranction force is transmitted by the strips of matting and the fastening strip itself to the associated supply reels.

In the case of the embodiment depicted in FIGS. 5 and 6 which works basically in the same way as the embodiment according to FIGS. 1 to 3, the connection between the relatively adjacent portions of roof matting is made by the fastening strip 130 covering the two laterally adjacent, but not overlapped, edges of the roof mat strips. driving power during traction The use of a fastening band or strip 30 or 130 to carry the fastening elements presents the further essential advantage that the fastening strip reinforces the junction areas between adjacent portions of roof mat in the direction of mat laying, that is to say parallel with the coal face.

An alternative method within the scope of the invention involves the driving or striking of fastener pins supplied automatically from a magazine into an overlap zone of the roof mat portions (FIG. 17A) extending in the direction of travel of the coal cutting machine. The margins of the roof mat portions would be deformed into respectively nesting channel shapes as shown. The fasteners would be introduced relative to the direction of the channel in such a manner as to penetrate laterally through the nesting channel-shaped parts 4*a*, 3*c* of the roof mat portions in the junction zone at two relatively spaced and aligned points in the side walls of the channels. However, with this kind of mat fastening it is necessary to coordinate between the frequency of operation of the fastener device and the speed at which the mat-laying device advances.

In FIG. 17B one mat portion 3 has integral fastening elements 3*d* at positions spaced apart longitudinally of one margin. This may either be upstanding as shown in broken lines or be bent up from coplanar relation with the mat portion 3 in between its storage position and the applicator device. Further deformation into the clenched position shown in full lines would be effected in the applicator device by means such as are shown in FIG. 13 and by the upper and lower jaws.

It may be advantageous to provide a substantially vertical spindle mounted in suitable position on the transporting means, about which spindle the fastening device, preferably jointly with the roof mat laying device, may pivot in the event of excessively drastic deviations occurring in the path of movement of the transporting device relative to the direction of the previously laid length of the new roof mat strip.

It is desirable that at the time of penetration of the mat portions by the pins or projections of the fastening strip, the latter should be as nearly as possible at right angles to the plane of the mat portions to facilitate penetration if the latter is made of, or includes, imperforate material such as foil, or to facilitate passage through apertures of the mesh if the mat material is composed wholly of wire mesh. The included angle between the fastening strip and the mat portions would be an acute angle normally having a value less than 45°, for example of the order of 20°, and it is, therefore desirable that the pins or other projections should have an angle of lead of this value with respect to the remainder of the fastening strip, i.e. they should be inclined backwardly with respect to the direction of travel and towards the point at which the fastening strip and the mat portions meet each other.

For this purpose a device may be included in the embodiments of apparatus hereinbefore described for bending the outer end portions of transverse elements of the fastening strip in an appropriate direction while remaining in the plane of the fastening strip preparatory to the latter being deformed by the device shown in FIG. 15 or its equivalent.

Figure 18:
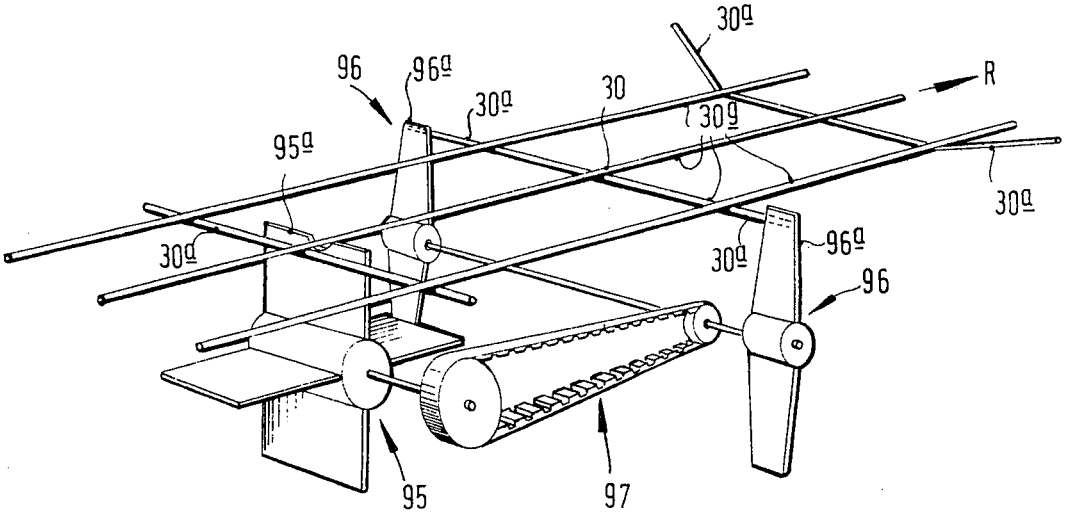
FIG. 18 shows a device for initially bending pin-forming elements of a fastening strip to provide an angle of lead of such elements.

For this purpose a further deforming device may be provided, one embodiment of which is illustrated in FIG. 18.

In this embodiment transverse elements of the strip have central portions 30*e* which are integral with laterally projecting pin forming portions 30*a* and lie in the same plane as longitudinal members 30*g* which are welded to the transverse members. The central portions 30*e* act as driving members when the strip is drawn forward in the direction of arrow R and engage with the blades or teeth of a driving element such as a gear wheel or paddle wheel 95 to cause this to be rotated intermittently or continuously depending upon the longitudinal pitch between the elements 30*e* and the number of teeth of paddle blades.

A pair of driven elements 96 are provided adjacent to the lateral margins of the fastening strip, these being in the form of gears or paddle wheels having teeth or blades engaging with the pin-forming portions 30*a*.

The driven elements 96 are driven at a higher speed than the speed of rotation of the driving element 95 so that the pin-forming elements 30*a* are bent forwardly in the direction of travel R, power for this purpose being derived from the tractive effort applied to the stored portion or coil of fastening strip as the apparatus is advanced with the coal cutting machine.

The number of teeth or blades and the gear ratio of a chain and sprocket drive or other suitable transmission means 97 positively connecting the driving and driven elements is selected to ensure the requisite degree of bending of the elements 30*a* and to maintain a proper phase relation between the teeth or paddles of the driving and driven elements so that, when a given tooth or paddle 95*a* of the driving element is just in front of an associated transverse element 30*e*, teeth of paddles 96*a* are just behind the extremities of pin-forming portions 30*a*. In the particular example driving element shown as having four teeth or paddles, and the driven element as two, while the gear ratio provided by the transmission means 97 may be 2 : 1.

In use the device illustrated in FIG. 18 may be interposed between a coil, such as 133, FIG. 15, of fastening strip having its pin-forming portions 30*a* coplanar with the remainder of the strip and colinear with the transverse portions 30*e* and the strip drawn off from this coil may be passed through the device shown in FIG. 18 and then between the male and female dies 151, 154 of the device shown in FIG. 15, whereby the pin-forming portions are bent into a position transversely to the plane of the remainder of the strip but retain an angle of lead due to the positions to which they will have been bent by the driven elements 96.

In the embodiment of apparatus shown in FIGS. 19 to 22, the means for moving the apparatus along the coal face is a coal cutting machine comprising a body 301 on which is mounted a cutting cylinder (not shown). The direction of travel of the machine along a track parallel to the coal face is indicated by the arrow P. On the body of the machine 301 there is secured a base plate 303 of the presently described apparatus comprising three dovetail-shaped guideways 304, 305, 306 extending transversely of the direction of travel of the machine.

Mounted on the guideway 304 is a stand or frame structure 307 fabricated from vertical and horizontal plates and engaging in the guideway 304 by means of a slide plate 309. A spindle 311 supported from the stand 307 as a cantilever is secured to a plate 310 and is disposed in the interior of the stand and carries a sleeve 312 rotatably fitted on said spindle 311. This sleeve 312 can be braked by means of a spring loaded brake means 313 (FIG. 2) provided at its free end, and a further sleeve 314 carrying a coiled supply 320 of roof matting is pushed over the sleeve 312, the two sleeves 314 and 312 being relatively fixed in such a manner that the braking action of the brake means 313 will be transmitted to the roof mat coil 320 mounted on the sleeve 314. A further mounting stand or frame 308 similar to that above described comprises corresponding parts designated by reference numerals corresponding to those already used in describing stand 307 and is mounted for movement along guideway 305. This stand 308, however, carries a supply of fastening strips which in the illustrated example comprises a plurality of discrete coils 330.

Figure 19:
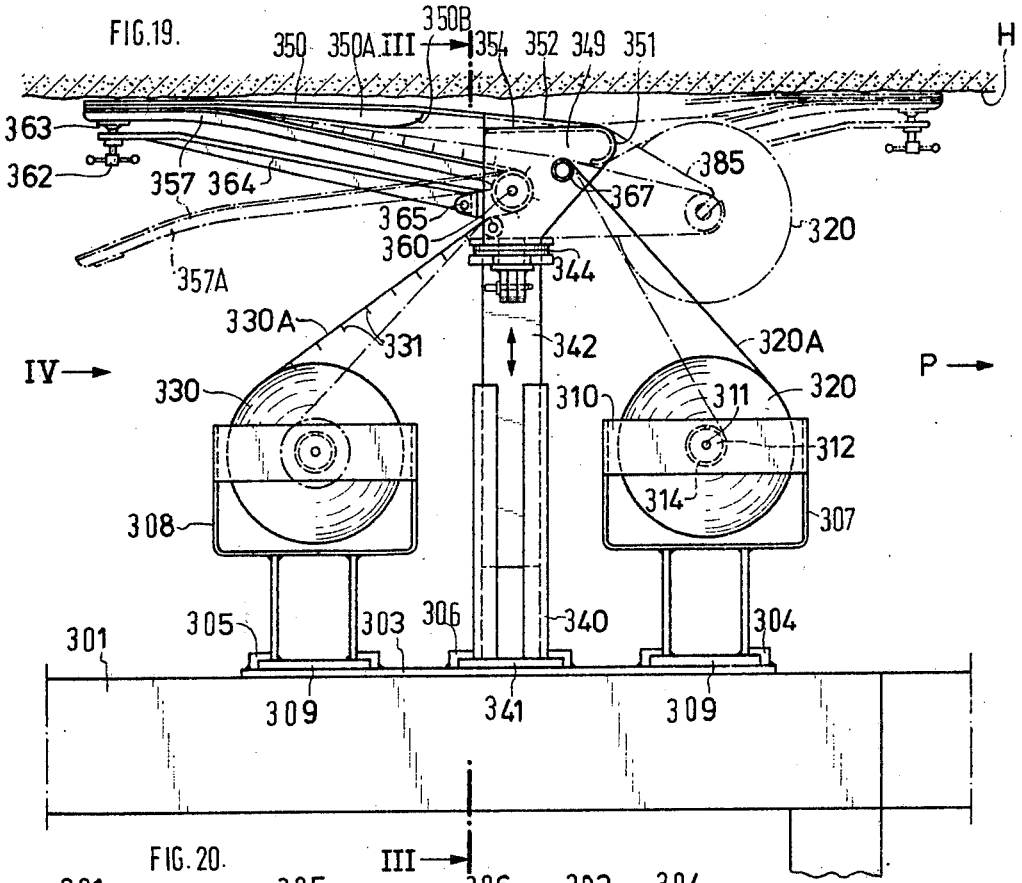
FIG. 19 is a view in side elevation of a further embodiment of apparatus in accordance with the invention, shown in continuous lines for one direction of travel of the coal cutting machine and in dot-and-dash lines in the position occupied for the opposite direction of machine travel.
Figure 20:
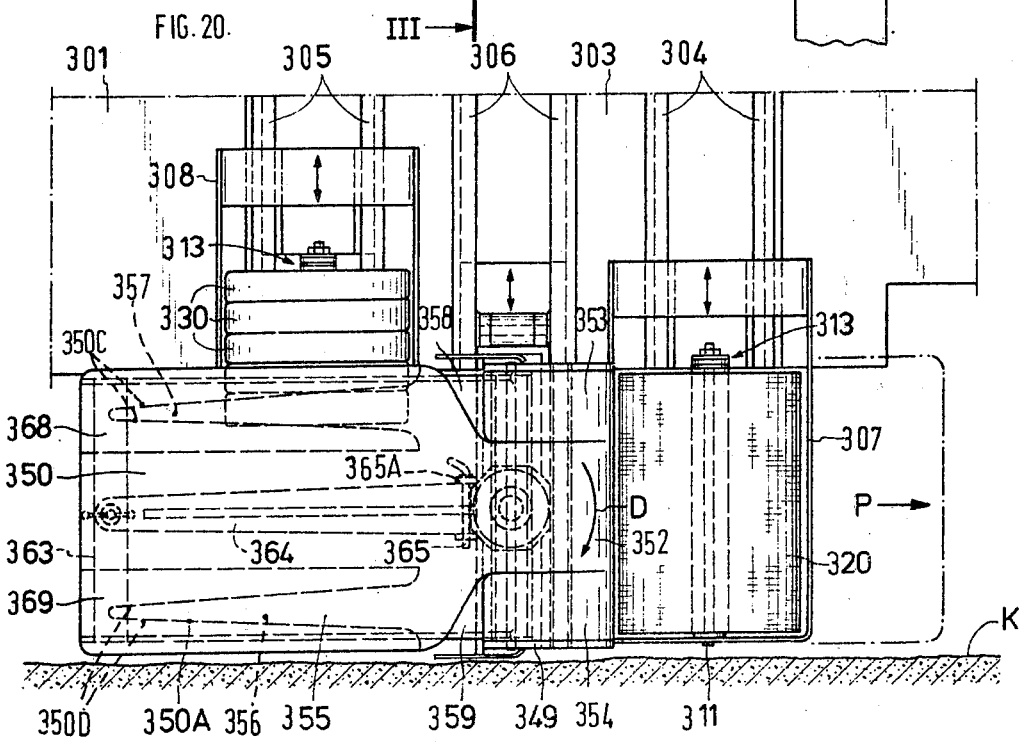
FIG. 20 is a plan view of the apparatus of FIG. 19.
Figure 22:
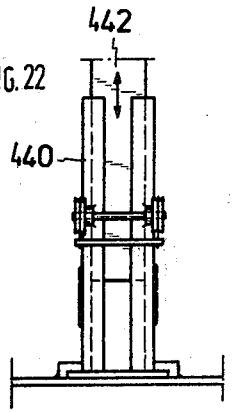
FIG. 22 is a view in the direction of the arrow IV in FIG. 19.
Figure 23:
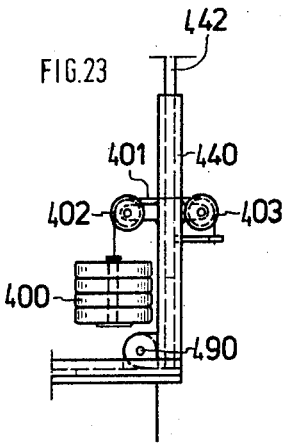
FIG. 23 is a view in side elevation of one embodiment of a vertically adjustable supporting prop for use in the apparatus of FIGS. 19 to 22.
Figure 24:
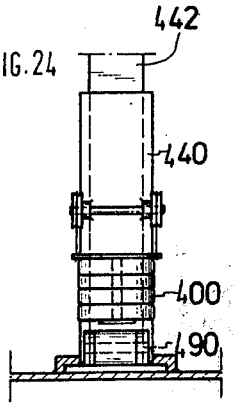
FIG. 24 is a view in end elevation of the prop of FIG. 23.
Figure 25:
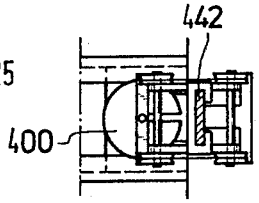
FIG. 25 is a view in side elevation of the prop of FIG. 23 viewed from the opposite side.
Figure 26:
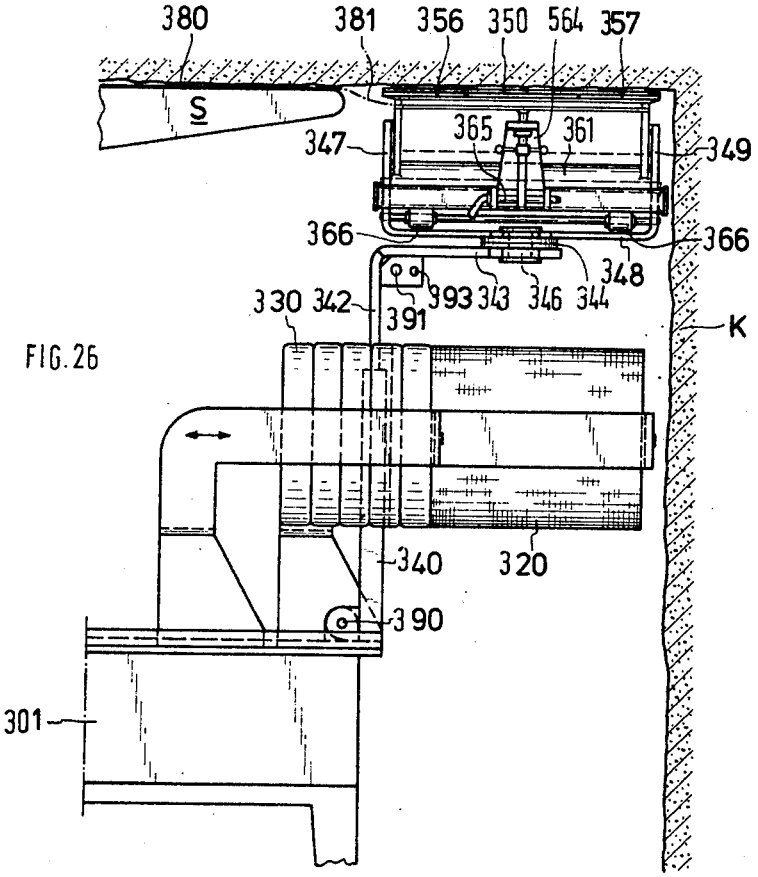
FIG. 26 is a plan view of the prop of FIG. 23.

FIG. 20 shows the stand 307 which carries the roof mat coil 320 in an advanced position near the newly exposed coal face K, and from which a portion 20A of the roof matting extends. For simplicity the remainder of the extending portion of the roof matting is not shown, but it will be understood that this will already have fitted and secured against the roof by the roof supports such as 5 following the machine. Roof matting will continue to be drawn from coil 320 in the course of continued forward travel of the coal cutting machine by reason of the tractive force applied by the machine to the coil of the roof mat. The same thing occurs, substantially sensibly as shown in FIGS 19 and 22, in respect of the fastening strip 330*a*which incorporates fastening elements 331 of pin-like form. The mounting stand 8 requires to be slidingly advanced along its guideway 305 towads the newly exposed face by no more than the average width of two coils 330 to occupy the correct functional position when the coil 330 nearest to the coal face K has been used up, the associated sleeve 314 of the consumed coil 330 being automatically dropped or ejected and the next coil advanced to the operative position.

Figure 21:
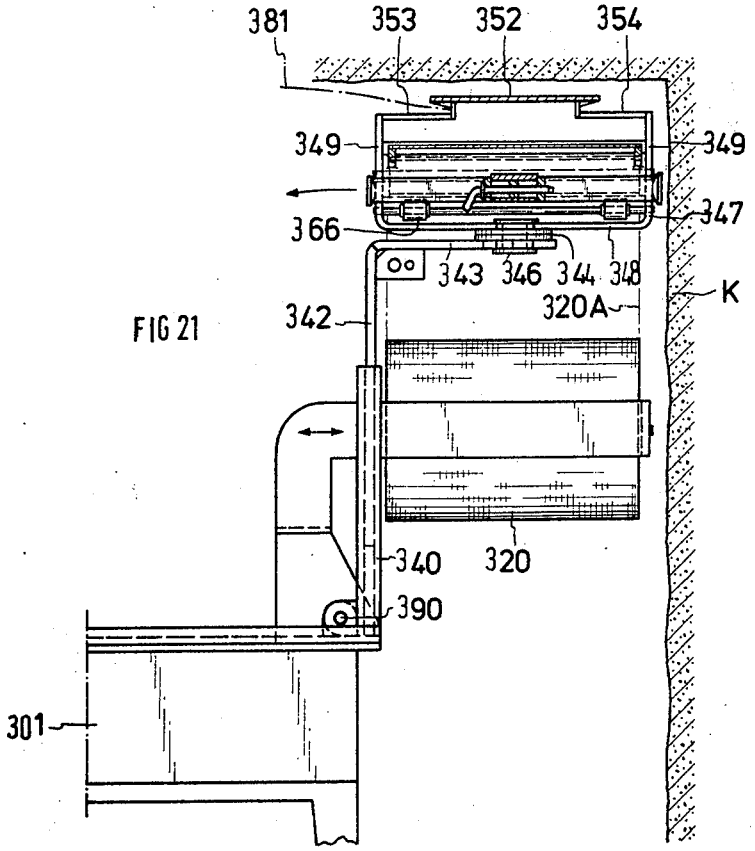
FIG. 21 is a section taken on the line III—III in FIG. 19.

The guideway 306 carries a supporting prop comprising a pair of telescopically engaged members whereof the lower member 340 is equipped with a base plate 341 engaging in the guideway 306. The upper member 302 of the telescopic prop carries a cantilever arm 343 (FIGS 21, 22) which in turn carries a vertical pivot bearing comprising a pair of discs 344 and a pin 346 extending therethrough, such bearing further being provided with locking means (not shown). The bearing in turn carries a housing 347. This housing 347 comprises a comparatively narrow bottom plate 348 welded to the upper bearing disc 344, a pair of side plates 349 and a top plate 350 of larger surface area leading to a downwardly inclined portion 352 and terminating in a downwardly curved portion 351. On opposite sides of the (central) portion 352 a pair of lateral portions 53, 54 of the top plate provide substantially horizontal platforms. The remaining portion 355 of the top plate 350 widens progressively from the middle portion 352 to substantially the full width of the roof mat 320A which is covered thereby. As a whole the plate 350 constitutes the upper jaw of the mat-applicator device which further comprises two lower jaws 356, 357 (FIG. 22), and the wider region 355 is arranged above the plane of the platform 353, 354 leaving gaps or splits 358, 359 extending transversely of the device as a whole between the portions 355 and the portions 353, 354. Of the two lower jaws which ascend towards the rearward end of the upper plate 350, the jaw 356 is associated with the platform 353 and the slit 358, whilst the jaw 357 is associated with the platform 354 and the slit 359. Each of the lower jaws consists of a metal strip such as is seen at 357*a* reinforced on its underside so as to be rigid, and welded at one end to a tubular part 361 which is rotatable on a spindle 360 connecting the housing plates 349. Consequently the jaws 356, 357 can be pivoted downwards to occupy the position indicated in dot-and-dash lines in FIG. 19 provided the supporting arm 364, which applies the lower jaws 356, 357 to the upper jaw 350 by means of a spindle 362 and bridge part 363 connected therewith, has first been disengaged from the housing 347 to which it is attached by quickly releasable connection such as pin 365 which can be axially withdrawn from aligned opening in arm 364 and a mounting bracket 365A (FIGS. 21, 22).

In the example shown in FIGS. 19 to 22 the fastening strip 330A which is drawn from the supply 330 is fed to the applicator jaws 350, 356 on the side of the apparatus remote from the coal face. The strip 330A passes over a pulley or roller 366, engaging between the fastening pins 331 which are preferably arranged in a pair of longitudinal rows and prevents the pins 331 from being obstructed by the projecting edge of the lower housing plate 348 (FIGS. 3,4). Thereafter, the strip is drawn over tube 361. The tube 361 will deflect the fastening strip 330A in such a way that the fastening pins 331 which arrive at this point in dependent or downwardly directed positions will continue to travel in erected positions. The roof mat portion 320A which is drawn from the supply 320 is fed between the jaws 350, 356 over the tubular part 367 which stiffens the housing 347.

When the mat-applicator device occupies an operational position for travel of the apparatus in the direction of the arrow P (FIG. 19), the margin 381 (FIG 21) of the roof mat portion 380 which was laid during the preceding pass of the coal cutting machine, will at this stage already be supported by the roof supports such as are indicated at S in FIG. 4. The already laid roof mat portion 380 is securely fastened to the edge of the new roof mat portion 320A by means of the fastening strip 330A, for which purpose the margins 381 of already laid roof portion 380 passes over the platform 353 (FIG. 21) and through the slot 358 (FIG. 22) into the gap between the jaws 350 and 356 (FIG. 19).

As seen in FIGS. 19 and 20, part 50A corresponding functionally to the plate shown in FIG. 13 is mounted at the underside of the upper jaw 350 and inclines from the left to right downwardly towards the lower jaws 356, 357 terminating at its right-hand end in an arcuate part 350B extending upwardly so as to define, in combination with the lower jaws, a convergent entrance for the roof mat portion 381 and the margin of the roof mat portion 380 together with the fastening strip 330A.

The part 350A has two slots having convergent boundaries 350C, 350D which serve to deform the projecting elements 331 of fastening strip by bending them inwardly as the strip travels from the entrance to the exit of the passageway defined between the upper and lower jaws of the applicator. Ordinarily the mat portions 381 and 380 will be in superposed relation with each other but if their edges, although proximate, should be slightly spaced these edges will be drawn laterally together by the action of the convergent slots on the fastening elements as these are deformed laterally inwardly. Final clenching of the fastening elements is effected by downward pressure exerted by the unslotted forward extremity of the part 350A against counterpressure exerted upwardly by the forward ends of the lower jaws 356, 357.

The portions of the fastening pins 331 which have penetrated through both matting portions 320A and 380 as they pass through the narrow gap at the ends of the jaws 350, 356 which are pressed together by the spindle 62, are turned over into a clenched or flattened position on top of the roof mat portions to form effective hooks or clips for jointly, or separately, as the case may be, securing the roof mat portions to the fastening strip.

The adjustment of the mat-laying and fastening applicator device to the requirements of travel in the opposite direction to arrow P requires only a few and easily executed manipulations involving comparatively very little effort and time. Firstly, the applicator device is disengaged from the remaining length of matting and/or fastening strip and then powered to a suitable extent for prevailing conditions by lowering upper member 342 of the telescopic prop. Then the prop 340, 342 is retracted in its guideway 306 sufficiently far to allow the applicator device supported on the cantilever arm 343 to be pivoted in the direction of arrow D (FIG. 20) without engaging the coal face. Next, the locking mechanisn for the bearing 344 is disengaged and the applicator device is turned into the oppositely directed position indicated in dot-and-dash lines in FIGS. 19 and 20, the locking mechanism then being automatically re-engaged and the prop returning slidingly in its guideway into the correct functional position for the device to operate in the new direction, followed by re-extension or erection of the prop to lift the device to the correct vertical level. As a result of these manipulations the part 368 of the device comprising the jaw 356 indicated in dot-and-dash lines in FIG. 2, will assume the functionally inoperative position near the coal face, whilst the other part 369 which previously occupied this position and which comprises the jaw 357 occupies the functional position on the side remote from the coal face.

Finally the mounting stands 307 and 308 are fitted respectively with a new matting and fastening strip supply in opposite order to that shown in FIGS. 19 to 22, or unconsumed supplies of matting and fastening strip are changed over from one side to the other whereby the new setting up process for the equipment is completed, and work can proceed in the new direction of travel of the coal cutting machine.

An alternative mounting of the roof mat coil 320 which sites this coil at a level where it is exposed to very little danger of being hit and damaged by slabs of coal breaking away from the coal face, is shown in dot-and-dash lines in FIG. 19. In this case the supporting spindle for the coil 320 is not cantilevered but, with a view to allowing the coil to be used in both directions of rotation, the spindle is removably at both of its ends in a pair of slots in lugs 385, which latter are themselves secured in suitably spaced positions on the housing 347.

The lower member of the telescopic prop 340–343 is attached to its base plate 341 which slides in the guideway 306 by a joint 390 (FIGS. 21, 22). This joint is so arranged as to permit of tilting of the prop in a direction away from, but not towards, the coal face. The joint allows the previously suitably lowered device being tilted, e.g. into the position shown in dot-and-dash lines in FIG. 21, if it should be important to prevent the device from hitting against any part of the support system in the course of pivoting.

In the embodiment shown in FIG. 22 the telescopic prop is provided with a second joint 391 which connects the cantilever arm 343 with the upper prop member 342, permits downward tilting of the device after disengagement of a locking bolt 393. The combined provision of two joints 390, 391 has the advantage of permitting folding or collapsing the prop device 340–343 into approximately Z configuration. This imparts even greater spacial adaptability to the device for adjustment and setting up in a change-over from one direction of travel of the coal getting machine to the other. Such folding or collapsing of the prop in Z configuration is particularly useful if, in an alternative embodiment to that shown in FIGS. 19 to 22, two separate sets of mat-laying and/or fastener applicator devices are provided, one set being arranged for use in one direction of travel and the other set being arranged for use in the opposite direction of travel, the respectively inoperative set being carried along by the machine ready for functional service as soon as the machine operates in the opposite direction. A mat and fastener applicator device which is functionally designed for working in one direction only is less wide and also weighs less than one designed for working in both directions. It will be appreciated that the manipulations required for adjusting the device may be further simplified and potentially made safer by the provision of simple auxiliary equipment such as, for example, manually operated piston and cylinder units, hand levers, or the like.

FIGS. 23–26 illustrate an embodiment of the prop 340–342 for use when it is desired that the mat laying device shall be maintained in contact with the roof even for variable roof levels. Such prop includes a biasing means comprising a suspended weight 100, which transmits up-thrust to the upper prop member 142 on which the mat-laying device is supported, by means of grooved pulleys 102, 103, which are part of a block and tackle system 101, one part of which is supported on the lower member 140 of the prop, and the relatively movable part of which is secured to a bracket 104 welded to the upper prop member 142. The weight 100 which is conveniently comprised from a plurality of removable discs can be selected or adjusted to such a value that it will not only take up the static load arising from the mass of the parts supported by the prop but also a dynamic load arising from tension in the mat portion and fastening strip undergoing installation due to movement of the coal cutting machine and the operation of the brake means in relation to the roof mat coil and fastening strip. In addition the weight 100 should also have a certain excess the value of which will depend on local conditions, to press the applicator device against the roof, either directly or with the interposition of an elastic device (not shown). If vertical variations are liable to be encountered which exceed the maximum up-thrust provided by the weight 100, it is possible to provide a reduction gearing (not shown) through which the weight acts to remedy the situation. The weight 100 which is shown freely suspended in the drawing may be provided with appropriate guides to prevent undesired pendulum movements.

It will be appreciated that the function of the suspended weight 100 may alternatively be performed by a pair of communicating hydraulic rams of suitable weight and stroke dimensions for the purpose in question.

Figure 27:
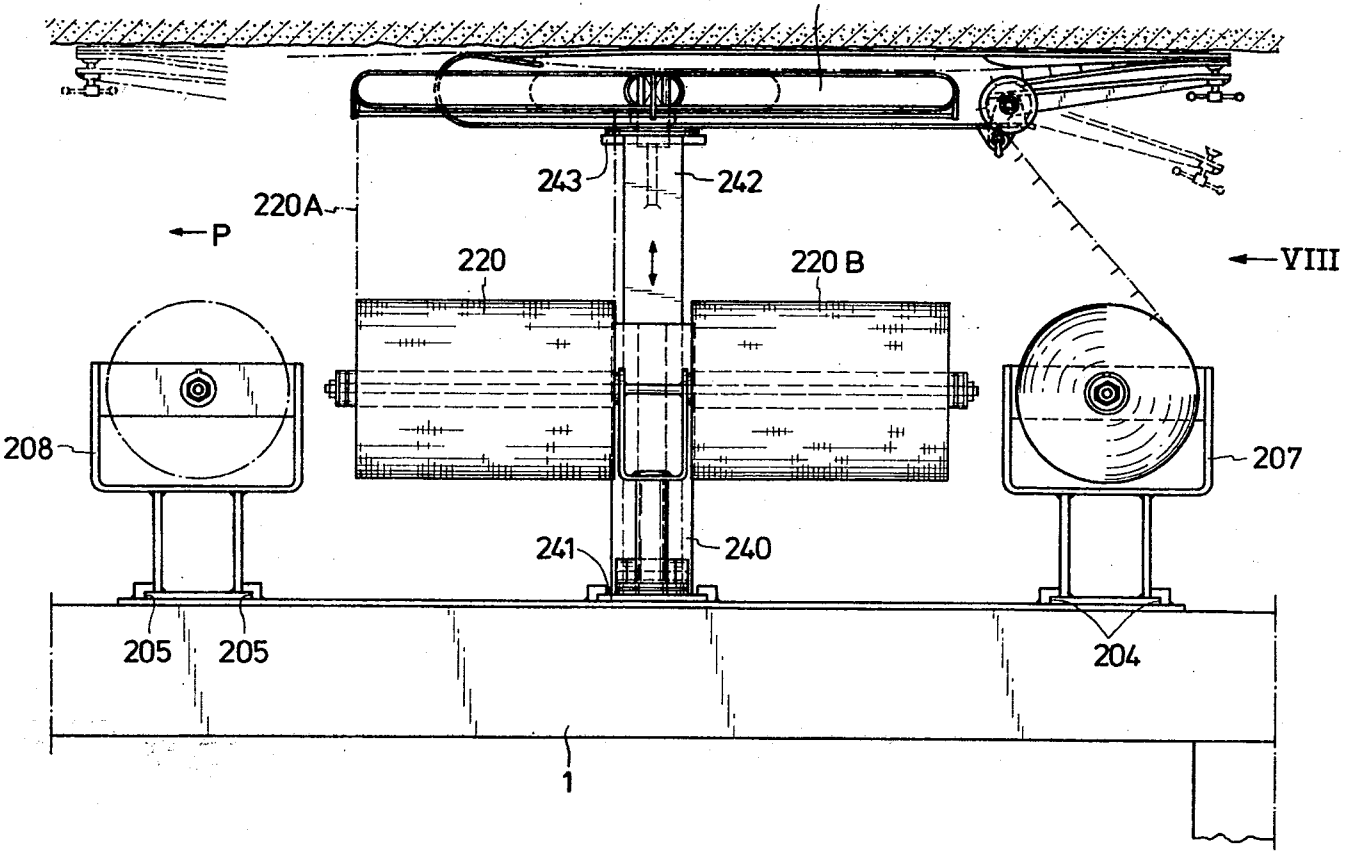
FIG. 27 is a view in side elevation of a modified embodiment as compared with FIG. 19.
Figure 28:
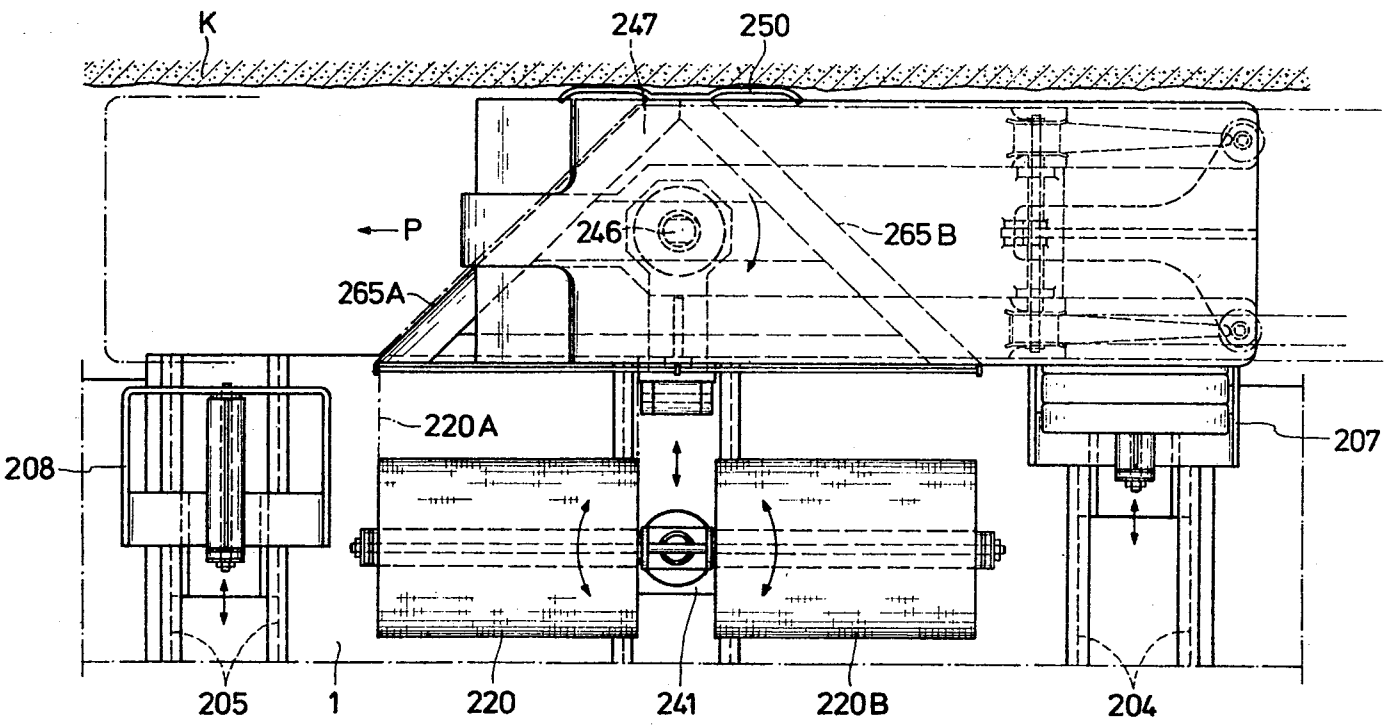
FIG. 28 is a plan view of the apparatus shown in FIG. 27.
Figure 29:
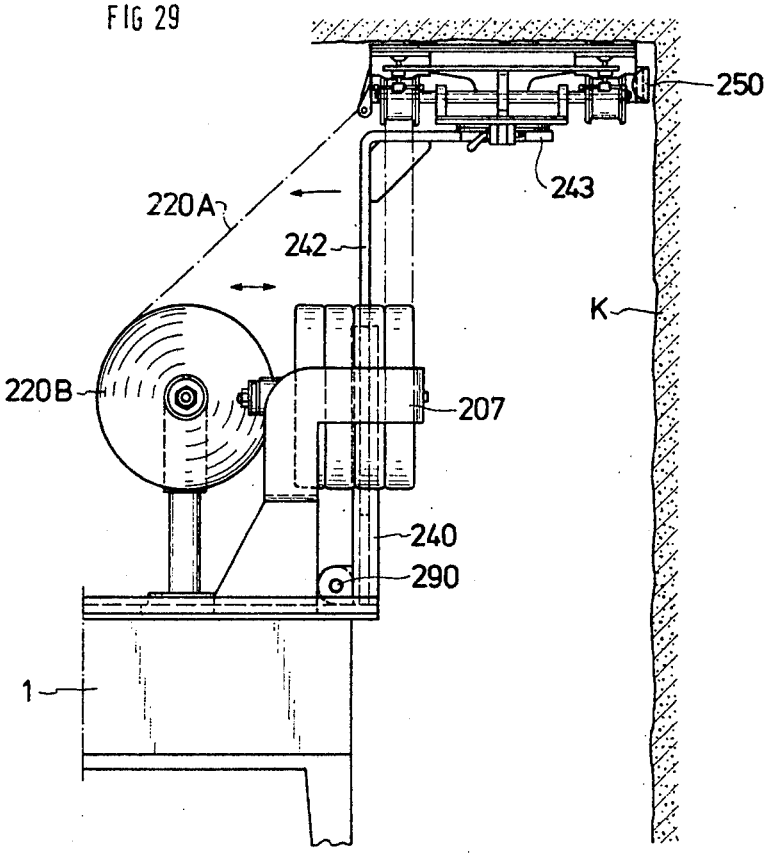
FIG. 29 is a front view in the direction of arrow VIII in FIG. 27.

The embodiment illustrated in FIGS. 27 to 29 differs from the embodiment illustrated in FIGS. 19 to 22 chiefly as regards to the following matters. During travel of the coal cutting machine 201 in direction of arrow P (FIGS. 27, 28), the apparatus draws the roof mat 220A from a coil 220 mounted on the apparatus with the coil axis parallel with the direction of travel. The extended mat portion is guided over the leading face 265A of a guide means, which edge face is angled as viewed in plan at 45° to the direction of travel generally parallel to the coal face K. For working in the opposite direction, the guide means includes an oblique deflector face 265B also at 45° to the direction of travel but at right angles to face 265A. The guide means may thus comprise a triangular housing 247 and over which roof mat portions can be drawn selectively from either a first coil 220A or a second coil 220B. The coils are aligned axially with each other and are supported from a pillar which, after release of a locking mechanism, is rotatable about its own vertical axis, in such a way as to be pivotable in both directions (double arrows in FIG. 28). This pillar is secured to the sliding base plate 241 of the supporting prop. For transporting of the fastening strip supply the apparatus includes a pair of mounting stands 207, 208 slidable in guideways 204, 205 whereof one, 207, carries a supply of strip being for use for direction of machine travel indicated by arrow P. The other mounting stand 208 is shown as retracted into an inoperative position and is for this direction of travel unloaded.

The embodiment of apparatus shown in FIGS. 27 to 29 provides particularly good protection for all parts against potential damage caused by falls from the coal face. Its adjustment or setting up from one direction of working to the other requires very few manipulations, especially if sufficient roof mat and associated fastening strip supply is carried for one operative pass of the machine with the corresponding supplies for the return journey carried on the otherwise empty second supporting spindles. In fact, the whole work involved in such adjustment and loading of the device for working in the opposite direction of travel is confined to lowering the mat applicator device 260 from the roof and pivoting it about the vertical pin 246 which is rigidly connected with the cantilever arm 243 of the prop 240–242. The triangular housing 247 presenting the deflector faces 265A, 265B does not require to be pivoted, i.e. can remain in the same position for both directions of travel. The housing 247 is thus fixedly secured to the vertical pin 246 against rotation.

In the embodiment illustrated in FIGS. 27 to 29, the apparatus also includes a joint 290 in the foot or base region of the supporting prop 240–242 which allows tilting of the device away from the coal face. Due to the provision of this joint and to a shoe 250, the mat applicator device can yield in the rearward direction, i.e. away from the coal face, in the event that during travel the path of travel should be such as to cause the bearing shoe 250 at the forward end of the device next to the coal face K to engage the face K. This may arise from variation in the direction of travel and/or from a projection on the face K.

I claim:

1. A method of supporting the roof of an underground mine working comprising stationing beneath said roof a flexible mat having a stored portion and extended portion leading off from said stored portion, supporting said extended portion at an elevated position adjacent to said roof, holding said elevated portion stationary at a succession of such elevated positions while moving said stored portion along a succession of generally parallel laterally offset paths to withdraw further lengths of mat from said stored portion, and underpinning said extended portions at intervals along their lengths by prop-supported superstructure, the improvement comprising the steps of:

a. bringing into proximate relation an edge of the extended portion of mat undergong application to the roof along each of said paths with an edge of the extended portion of the mat applied to the roof along the immediately preceding one of said paths, and b. mechanically fastening said extended portions together adjacent to said proximate edges as the mat undergoing application is applied.

2. A method according to claim 1 further comprising the step of:

a. applying forces to the extended portion of mat undergoing application to the roof and to the portion of mat occupying the immediately preceding path at least to reduce sag of such portions, b. moving the area over which such forces are applied in conformity with advancement of the stored portion.

3. A method according to claim 1 wherein the mechanical fastening is effected by a. penetrating respective margins of said portions of mat bordering said edges thereof by deformable fastening elements, b. deforming said fastening elements to establish an interlocked relation between said fastening elements and said margins.

4. A method according to claim 3 comprising:

a. moving a supply of said fastening elements along each of said paths while said stored portion of mat is moved therealong, b. withdrawing successive fastening elements from said supply during movement thereof, c. interengaging said fastening elements with said extended portions of mat occupying successive adjacent ones of said paths.

5. A method according to claim 1 wherein the mechanical fastening comprises the steps of:

a. providing fastening elements at spaced positions along a fastening strip, b. moving the fastening strip in stored form along said succession of paths with said stored portion of said mat, c. applying an extended portion of said fastening strip to said extended portions of mat occupying adjacent ones of said paths to interlock with said mat portions respectively.

6. A method according to claim 5 wherein:
a. the fastening strip incorporating said elements is stored in coiled form,
b. an extended portion of said coiled strip is moved along each of said paths in proximity with said stored portion of the mat undergoing movement therealong whereby said strip is unwound to bring the extended portion thereof into overlapping relation with said marginal regions of adjacent extended portions of said mat.

7. A method according to claim 3 wherein:
a. said fastening elements are provided with projecting pin portions,
said fastening elements with their pin portions in an upstanding position are pressed upwardly through margins of said mat portions bordering said proximate edges.

8. Apparatus for applying a flexible mat to the roof of a mine working along a plurality of generally parallel laterally offset paths comprising:
a. mobile means including a body, means thereon for storing a portion of flexible mat while permitting an extended portion to be led off from said stored portion for application to the underface of the roof,
b. applicator means for bringing into proximate relation an edge of the extended portion of mat applied to the roof along each of said paths and an edge of the extended portion of mat applied along the immediately preceding path,
c. means for mechanically fastening said extended portions of mat together adjacent to said edges.

9. Apparatus according to claim 8 wherein:
a. said mobile means also includes means for storing a plurality of deformable fastening elements,
b. said applicator means includes means for guiding fastening elements into spaced positions along a fastening zone and in overlapping relation with margins bordering said proximate edges of said extended portions of said mat.

10. Apparatus according to claim 9 wherein:
a. said means for storing said fastening elements comprises means for storing a strip in coiled form incorporating said fastening elements at spaced positions therealong,
b. said applicator means includes:
i. means for guiding said strip to apply the strip in overlapping relation with respective margins of said extended portions of said mat,
ii. means for causing said fastening elements to interengage with said margins,
iii. means for deforming said fastening elements to provide an interlocked connection between said elements and said margins.

11. Apparatus according to claim 8 wherein said applicator means includes:
a. lower jaw means defining the lower boundary of a feed path for said extended portion of said mat undergoing application to the roof,
b. upper jaw means defining the upper boundary of said path, said path being open at one at least of its lateral boundaries to admit of entry of the margin of the mat already applied along said immediately preceding path.

12. Apparatus according to claim 10 wherein:
a. the upper and lower jaw means define a passageway of reducing height through which at least said margins of said extended mat portions pass during operation of the apparatus,
b. the means for mechanically fastening said mat portions to each other comprises deformable fastening elements deformed by said jaw means in response to feed along said passageway into interlocked relation with said mat portions.

13. Apparatus according to claim 8 wherein the applicator means includes means for engaging the underside of the portion of mat occupying the path immediately adjacent to that occupied by the mat portion undergoing application to reduce sagging of the first said mat portion.

14. Apparatus according to claim 9 further comprising:
a. A first deforming means for deforming said fastening elements from a first form in which they are stored to a second form in which they present respective projecting elements for penetration of the mat portions,
b. a second deforming means in said applicator means for deforming said fastening elements into a third form in which they are interlocked with margins of said mat portions.

15. Apparatus according to claim 9 wherein:
a. said fastening elements each includes a base element and laterally spaced projecting elements connected to said base element,
b. said guide means of said applicator means includes
i. means for causing said projecting elements to penetrate the margins of said mat portions passing through said guide means,
ii. means for bending said projecting elements laterally after said penetration.

16. Apparatus according to claim 14 wherein said first deforming means comprises cooperative male and female dies defining a channel-shaped passageway for passage therealong of said fastening elements to deform same from substantially straight form along their paths to travel into channel-shaped form.

17. Apparatus according to claim 16 wherein said male and female dies define a passageway which in the direction of its length is of part-circular form.

18. Apparatus according to claim 8 wherein:
a. said applicator means defines a feed passageway for extended portion of the mat undergoing application of the roof, said feed passageway having an entrance and an exit,
b. said apparatus further comprises mounting means for said applicator means enabling the latter to be mounted in alternative positions in which its exit faces lengthwise of the parallel offset paths along which the flexible mat is applied in either of two opposite directions.

19. Apparatus according to claim 18 wherein said mounting means comprises:
a. an extensible upstanding prop means connected at its lower end to the body of the apparatus and carrying said applicator means at its upper end,
b. bearing means providing a vertical pivotal axis about which said applicator means may be angularly adjusted between said alternative positions.

20. Apparatus according to claim 18 wherein said mounting means includes further bearing means providing at least one horizontal pivotal axis generally parallel to the direction of said paths of movement for pivotal movement thereabout of said applicator means.

21. Apparatus according to claim 18 wherein:

a. said body is provided with a guide means defining a guide path extending generally horizontally and transversely of said parallel offset paths, b. said mounting means is assembled with said body through slide means engaging with said guide means for movement into any of a plurality of positions of adjustment therealong.

22. Apparatus according to claim 18 wherein said means for storing a portion of flexible mat includes stand means mounted on said body at positions spaced apart longitudinally of said offset paths and on opposite sides of said mounting for said applicator means.

23. Apparatus according to claim 22 wherein:

a. said body is provided with further guide means respectively on said opposite sides of said mounting means and defining respective guide paths extending generally horizontally and transversely of said parallel offset paths, b. each of said stand means is assembled with the body through a respective slide means engaging with a respective one of said guide means for movement into a plurality of positions of adjustment therealong.

24. Apparatus according to claim 18 further comprising deflector means defining part of a feed path for the mat portion undergoing application to the roof and operative between said store means and said applicator means, said deflector means having:

a. a first guide face arranged to guide said mat portion from said store means into the entrance of said applicator means when the latter is in one of its said positions, b. a second guide face arranged to guide said mat portion from said store means into the entrance of said applicator means when the latter is in the other of its said positions, said guide means being obliquely arranged to the path along which the mat undergoing application is to be applied symmetrically about an axis at right angles to such path.

25. Apparatus according to claim 24 wherein the store means comprises stand means for mounting coils of mat material having coil axes extending generally parallel to the path of application of said mat portions to the roof and on opposite sides of the mounting means for the applicator means.

26. Apparatus according to claim 8 wherein:

a. said applicator means is supported from said body by mounting means, b. said mounting means comprises extensible upstanding prop means connected at its lower end to said body and at its upper end to said applicator means, c. means are provided for biasing said prop means to an extended position to maintain pressure contact between said applicator means and said roof.

* * * * *